US005243921A

United States Patent [19]

Kruse et al.

[11] Patent Number: 5,243,921

[45] Date of Patent: Sep. 14, 1993

[54] ADJUSTABLE TABLE BASE

[75] Inventors: Gary L. Kruse, Spring Lake; James A. VanDoorne, Grand Haven, both of Mich.

[73] Assignee: Oliver Products Company, Grand Rapids, Mich.

[21] Appl. No.: 751,174

[22] Filed: Aug. 28, 1991

[51] Int. Cl.[5] ..... A47B 9/00

[52] U.S. Cl. ..... 100/147; 108/144; 248/408

[58] Field of Search ..... 108/144, 147, 146; 248/188.5, 423, 407, 408

[56] References Cited

U.S. PATENT DOCUMENTS

| | | | |
|---|---|---|---|
| 1,848,338 | 3/1932 | Garrow | 248/408 X |
| 1,888,478 | 11/1932 | Steidl | 108/147 X |
| 1,963,467 | 6/1934 | Keller . | |
| 2,228,727 | 1/1941 | Pain . | |
| 2,567,593 | 9/1951 | Bemis . | |
| 2,659,413 | 11/1953 | Cramer | 248/408 X |
| 3,117,392 | 1/1964 | Junicunc | 108/144 X |
| 3,517,626 | 6/1970 | Lambert . | |
| 3,554,585 | 1/1971 | Sorenson | 248/408 X |
| 3,741,514 | 6/1973 | Snurr | 108/144 X |
| 3,827,820 | 8/1974 | Hoffman . | |
| 4,113,221 | 9/1978 | Wehner . | |
| 4,350,463 | 9/1982 | Friedline . | |
| 4,365,522 | 12/1982 | Kubota . | |
| 4,391,160 | 7/1983 | Myers . | |
| 4,480,497 | 11/1984 | Locher . | |
| 4,640,484 | 2/1987 | Lamond et al. | 248/407 |
| 4,674,908 | 6/1987 | Kagerer . | |
| 4,693,442 | 9/1987 | Sills | 108/144 X |
| 4,922,784 | 5/1990 | Hidaka . | |

FOREIGN PATENT DOCUMENTS

| | | | |
|---|---|---|---|
| 536376 | 10/1931 | Fed. Rep. of Germany | 248/408 |
| 3841254 | 6/1990 | Fed. Rep. of Germany | 108/144 |
| 155135 | 12/1920 | United Kingdom | 248/423 |

*Primary Examiner*—José V. Chen

*Attorney, Agent, or Firm*—Price, Heneveld, Cooper, DeWitt & Litton

[57] ABSTRACT

A variable height table support assembly having a telescopic pillar between a lower base and an upper tabletop support platform, the pillar having an inner cylindrical member and an outer cylindrical member, cooperable with a detent biasing and locking apparatus. The detent is lockable through an opening in the outer cylindrical member and into one of more than one cavities in the inner cylindrical member, by a threaded, adjustable plunger It is also biased toward this opening and a cavity by a stabilizing spring when the plunger is backed off to unlock the detent. Preferably a gas cylinder extends through the pillar to assist elevation of the tabletop support, and cushion lowering thereof.

13 Claims, 2 Drawing Sheets

ADJUSTABLE TABLE BASE

BACKGROUND OF THE INVENTION

This invention relates to tables, and particularly to vertically adjustable table assemblies Studies of work habits and causes of worker fatigue have established the understanding that employee fatigue can be significantly lessened if the work surface can be varied in height during the work shift. Conventional work tables frequently support significant loads of materials, as well as the weight of the tabletop itself, and normally are of fixed height. A practical, variable height table would be particularly advantageous to lessen worker fatigue by enabling frequent adjustment thereof to different heights during the work shift, even to convert between standup and sit down work surfaces. Moreover, tables of different, readily changeable, height ranges would be desirable for use as wheelchair facilities, standup cocktail tables, in schools, nursery schools, churches, etc.

SUMMARY OF THE INVENTION

An object of this invention is to provide a work table which has a variable height work surface, readily changeable to any of variable heights while also effecting stability of the tabletop during the transition. The table could be used to lessen worker fatigue, as a wheelchair facility, in nursery schools, as standup or sit down work surfaces, or as cocktail tables and the like. The novel table has a telescopically variable support between the base and the table supporting platform, secured in selected telescopic relationships by a lockable detent unit. During vertical adjustment of the telescopic components, the detent, preferably a spherical ball, is unlocked, but still biased into the cavity or recess in which it fits, to guard against the tabletop falling freely in response to gravity. Rather, the top is movable in response to a pull up or push down on the tabletop, causing the biased ball to temporarily move out of a particular cavity, along a vertical track, and snap into another cavity under bias. The unit is then lockable in this new location.

Preferably, the structure also embodies a vertical lifting biasing device, namely a gas cylinder, to assist in elevation of the tabletop and to cushion lowering thereof.

These and other objects, advantages and features of the invention will become apparent upon studying the following specification in conjunction with the drawings.

DESCRIPTION OF THE PREFERRED EMBODIMENT

Figure 1:
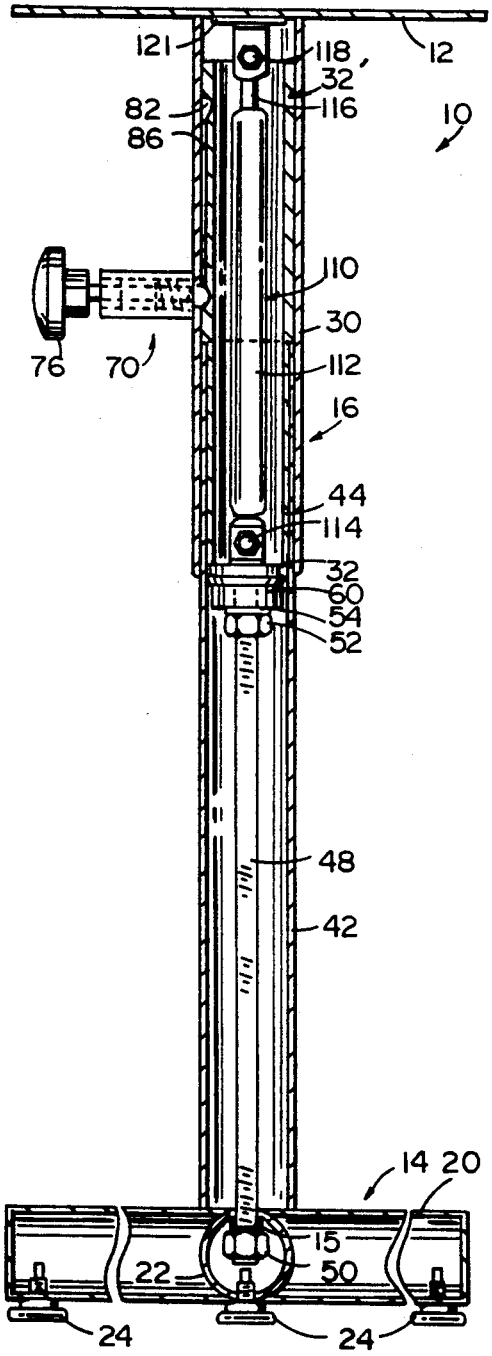
FIG. 1 is an elevational view of the adjustable table base support assembly of this invention.
Figure 2:
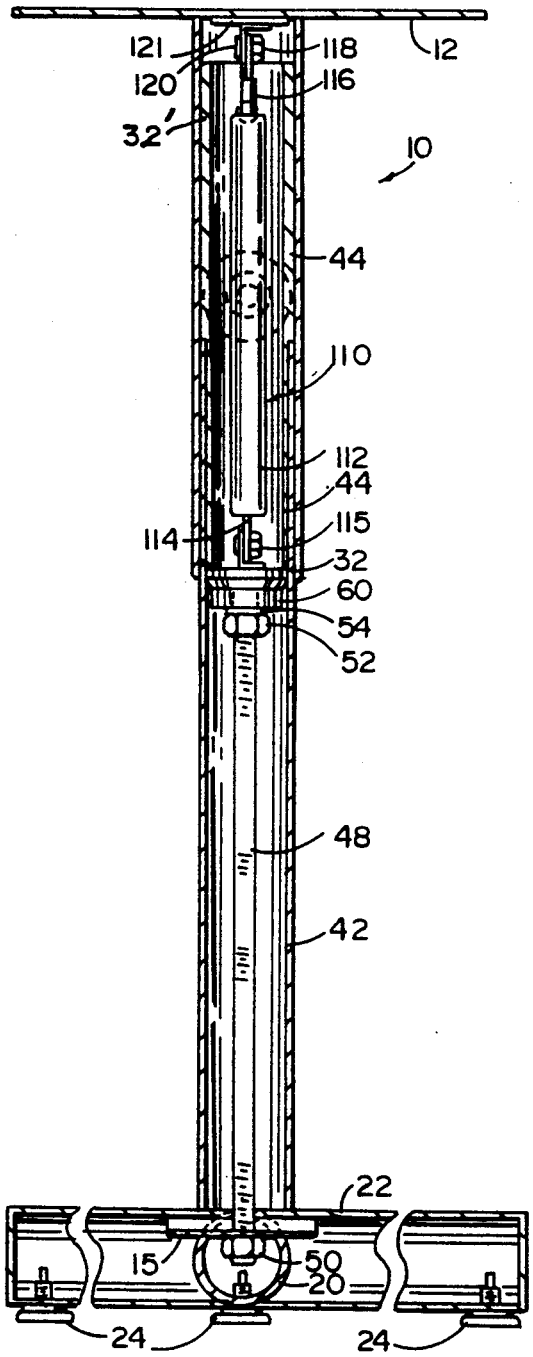
FIG. 2 is an elevational view of the assembly in FIG. 1, taken from an angle ninety degrees displaced therefrom.

Referring now specifically to the drawings, the table base support assembly 10 there depicted is shown to include an upper tabletop support platform 12 on which a tabletop (not shown) is to be mounted, a base subassembly 14 and an intermediate pillar support subassembly 16 between base 14 and support platform 12.

Support platform 12 may have a plurality of openings or the like through which fasteners can extend to fasten a tabletop to the platform.

Base subassembly 14 is shown to include a plurality of tubular horizontally extending supports 20 and 22 in X configuration, i.e., crossing each other, with a floor glide 24 threadably attached into the outer end of each member. Alternatively, there could be a pair of spaced, pillar and base subassemblies, with each base having a "T" shape on the floor.

In the preferred embodiment depicted, the pillar subassembly 16 has an upper outer cylinder and a lower inner cylinder arrangement with the outer cylinder 30 attached to platform 12 as by welding. The inner cylinder 42 is held securely to base 14 by a tie rod 48 to be described. It will be understood from the following description that these inner and outer components can be in inverted relationship without departing from the invention. Upper member 30 typically has a thin metal wall of cylindrical configuration with an inner diameter which corresponds substantially to the outer diameter of inner member 40 telescopically received therein. Inner cylinder 40 is preferably formed of two components, namely a thin walled lower cylindrical member 42 and a thick walled cylindrical extension member 44 in the upper end portion of lower member 42 and extending axially beyond the lower member within the confines of upper cylinder 30. The interface of inner lower member 42 with outer upper member 30 preferably includes a small polymeric engagement ring 32, as does the interface of extension 44 with member 30 i.e., ring 32', to minimize scuffing between the inner cylinder and the outer cylinder during vertical adjustment.

Inside of the hollow lower cylindrical member 42 is a vertically oriented, threaded tie rod or shaft 48 anchored at its lower end by extending through and into base 14 and reinforcing element 15 and secured by threaded nut 50 therein. The outer ends of legs 20 can have aesthetic end caps or plugs in conventional-manner. The upper end of rod 42 is threadably engaged with plug 60 shaped like a cylindrical disc or the like, and locked in place by a lock nut 52 and an optional lock washer 54. Plug 60 is welded on its upper surface to the lower end of the second, thicker walled cylindrical member 44, thereby anchoring extension member 44 and cylinder 42 to the base. That is, members 44, 42 and 14 are secured together by tie rod 48, element 15 and nut 50.

With this assembly, outer cylinder 30 is capable of moving vertically relative to the inner cylinder subassembly, in so doing gliding along the outer surface of thin walled member 42 and the outer surface of the upper portion of thick walled member 44. This vertical movement is readily done, but very specifically controlled as will be understood.

Figure 4:
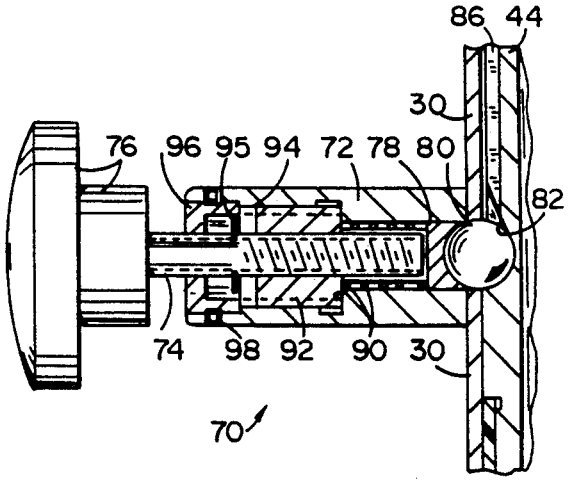
FIG. 4 is a fragmentary enlarged sectional view of a portion of the assembly, showing the detent locking means and the detent biasing means.

More particularly, control is obtained through a locking detent mechanism which also has a biasing detent function coupled therewith. This subassembly 70 is depicted more exactly in FIG. 4. It includes a cylindrical housing 72 having its axis normal to the vertical axis of the pillar subassembly and affixed by welding to outer cylinder 30 over a circular opening in cylinder member 30. Extending from the outer end of housing 72 is a threaded plunger or shaft 74 having an actuating knob 76 on the outer end thereof and threadably engaged with inner nut 92. This plunger is engageable on its inner axial end with a bushing spacer 78 as of brass, having a concave hemispherical inner face to engage a detent 80 which is preferably a ball. The inner hemispherical portion of ball 80 is engageable with concave cavities 82 located at different vertically spaced locations (FIGS. 1 and 4) in the thicker walled cylindrical member 44.

The diameter of bushing spacer 78 is greater than that of threaded shaft 74 so as to leave an annular surface on the outer end of spacer 78 engageable by one end of a helical compression spring 90, the opposite outer end of which engages the axial inner end of fixed nut 92. This nut is threadably fixed within housing 72 with peripheral threads 94. Cap 96 is secured on the outer end of housing 72 by a plurality of set screws 98. A suitable stop member 95, shown here as a snap ring, but alternatively being a rolled pin extending through shaft 74, is preferably secured to the shaft within housing 72 to limit outward movement of the threaded shaft, i.e., prevent shaft 74 from being turned out of housing 72.

The uppermost cavity or recess 82 has an inverted, generally teardrop shaped configuration having a smaller departure angle at its lower portion and a larger departure angle at its upper portion. This smaller angle enables detent ball 80 to be controllably movable out of cavity 82 and into an elongated axial track or groove 86 in cylindrical member 44. This track extends vertically between cavities 82. This large angle prevents the ball from moving further in that direction. The lowermost cavity 82 has an inverted, generally teardrop shaped configuration to enable the ball to controllably move up into track 86, but not down in the opposite direction. Two cavities are specifically illustrated in this depicted embodiment. However, it will be realized that three or more cavities may be provided along this track. In that event, each of the intermediate cavities will have a small angle on the top and the bottom thereof for controlled movement of the ball out of the cavity into the track in either direction. The engagement of ball 80 in track or groove 86 prevents platform 12 from rotating during vertical adjustment.

Figure 5:
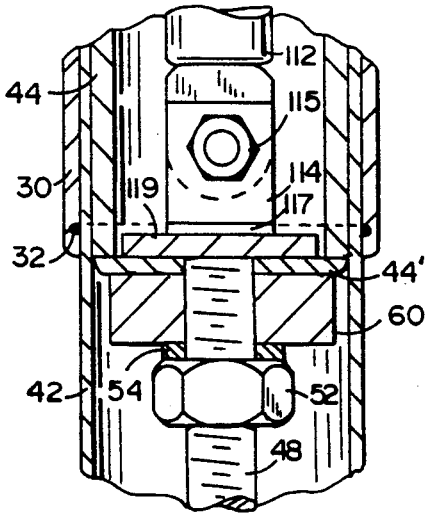
FIG. 5 a fragmentary elevational view of a portion of the assembly at the juncture of the interfitting telescopic members.

Preferably, the table support includes a gas cylinder assembly 110 or the like to assist in elevation of the tabletop, especially if under load, and to cushion lowering of the tabletop. This adds further stability to the structure Gas cylinder assembly 110 can be of conventional construction such as that in U.S. Pat. No. 4,946,143, entitled GAS SPRING, issued Aug. 7, 1990, and incorporated herein by reference. It includes an outer cylinder 112, one end 114 of which is mounted by a fastener 115 to an L-shaped bracket 117 which is welded to spacer 119 inside the lower axial end 44' of cylinder member 44 (FIG. 5) and rests on plug 60. Thus, pressure from the gas cylinder bears on these underlying elements down to the base of the table. Extending from the other end of cylinder 112 is a piston rod 116 connected within the gas cylinder to a piston (not shown) and sealed around piston rod 116 to the cylinder. The extended end of rod 116 is fastened by fastener 118 to an L-shaped bracket 120 which is welded to spacer 121 which bears on the bottom surface of platform 12. This gas cylinder contains a compressed gas to be biased to an extended condition, thereby assisting in elevation of the tabletop and cushioning lowering of the tabletop. Assembly of the gas cylinder into the hollow pillar is simple since the cylinder is not fastened on either end.

Figure 3:
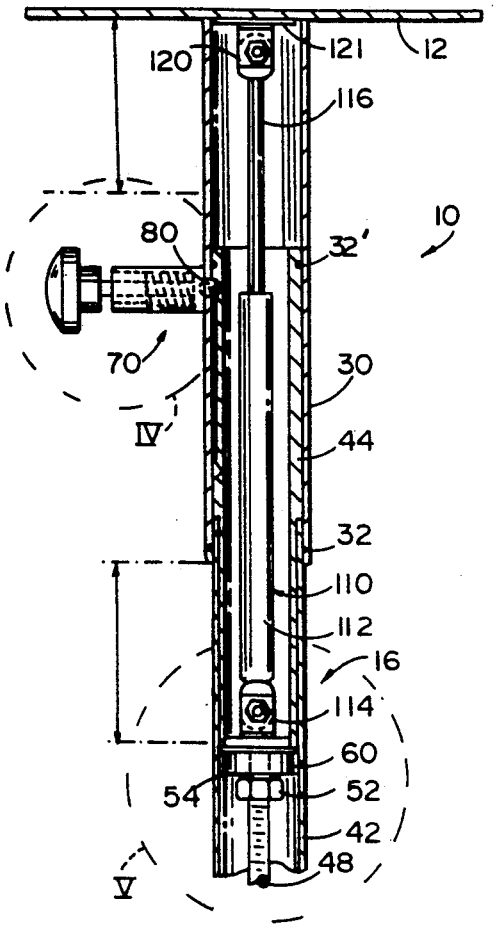
FIG. 3 is a fragmentary sectional elevational view of a portion of the assembly in FIGS. 1 and 2, shown with the structure vertically extended.

In operation, the height of the tabletop and platform 12 is locked into one particular selected position, e.g., in the lowered position of FIG. 1, by rotating knob 76 to cause threaded advancement of shaft 74 in nut 92, causing spacer 78 to be pressed against the outer hemispherical surface of ball detent 80, the inner hemispherical surface of the detent being engaged tightly with the similarly configured concavity 82 in the inner telescopic device. Detent 80, therefore, cannot escape cavity 82, thereby locking the telescopically adjustable column or pillar in this position. When it is desired to move the tabletop to another position, e.g., an elevated position like that in FIG. 3, knob 76 is threadably backed off, to thereby retract shaft 74 from bushing 78. However, detent 80 is still retained snugly in cavity 82 by the bias of compression spring 90 against spacer 78. Thus, even with unlocking of the detent, the tabletop, even in its elevated condition, would not tend to slam down under the force of gravity. However, the detent can be moved out of cavity 82 by added force from a person pushing down (or lifting up) slightly on the tabletop.

Further, in the preferred embodiment containing a gas cylinder subassembly 110, the tabletop will be even more readily elevated by assistance of the gas cylinder which is biased to an extended condition. The elevation of the tabletop thus moves ball detent 80 out of cavity 82, and along track 86, until the ball detent encounters the next cavity, at which times compression spring 90 will bias it into this next cavity to stop further movement. The biasing mechanism supplies vertical stabilizing characteristics to the structure even when the detent is unlocked, i.e., is moving in the track 86. If this is the selected readjusted height, the detent is locked in this condition by rotating knob 76 to cause shaft 74 to engage spacer 78 tightly.

Conceivably certain details of this construction could be modified from the preferred embodiment depicted herein and described as illustrative of the inventive concept. Therefore, it is not intended that the invention should be limited to the illustrated embodiment, but only by the scope of the appended claims and the reasonably equivalent structures to those defined therein.

The embodiments of the invention in which an exclusive property or privilege is claimed are defined as follows.

1. A variable height table support assembly comprising:

a table base for engaging a floor surface;

a telescopic pillar extending up from said table base and having inner and outer interfitting telescopic cylinders;

a tabletop support platform above said pillar;

said platform being secured to and resting on one of said telescopic cylinders, and said base being secured to and beneath the other of said telescopic cylinders;

detent biasing and locking means between said telescopic cylinders for alternately biasing and locking a detent between said telescopic cylinders, comprising:

an opening through said outer telescopic cylinder, and at least two vertically spaced, detent-receiving cavities in said inner cylinder, each of which is selectively alienable with said opening upon vertical movement of one of said telescopic cylinders with respect to the other said telescopic cylinder, and a movable detent in said opening;

a guide and retainer housing on said outer telescopic cylinder around said opening;

resilient detent biasing means in said housing arranged for applying a biasing force on said detent toward said inner telescopic cylinder and said cavities;

a detent-locking, threaded plunger having an external operating knob outside said housing, and said plunger extending into said housing toward said detent, and threadably adjustable in said housing toward said detent to lock said detent into a selected one of said cavities, and adjustable away from said detent to enable temporary retraction of said detent from said selected cavity against the bias of said detent biasing means;

said inner cylinder comprising a first cylindrical member, a second cylindrical extension member extending axially beyond said first cylindrical member inside said outer cylinder and having said cavities therein, and a support shaft inside said firs cylindrical member securing said second cylindrical extension member axially.

2. The variable height table support assembly in claim 1 wherein said biasing means is a compression spring.

3. The variable height table support assembly in claim 2 including a fixed stop engaged by said spring.

4. The variable height table support assembly in claim 1 including a spacer between said detent and said threaded plunger.

5. A variable height furniture support pillar assembly comprising:

an upper support platform, a lower base, and a telescopic pillar therebetween;

said pillar comprising inner and outer telescopically interfitted cylinder members;

said inner cylinder member having vertically spaced cavities and said outer cylinder having an opening alienable with selected ones of said cavities with vertically telescopic movement between said cylinder members, and said inner cylinder having a vertical slot between said cavities to receive a detent with a sliding fit;

a detent movable in said opening, and movable into or out of said cavities when aligned with said opening, and movable along said vertical slot between said cavities;

a housing on said outer cylinder at said opening;

resilient biasing means in said housing operable for biasing said detent into an aligned one of said cavities;

movable locking means supported by said housing for movement toward said detent means to lock it in position at said opening and one of said cavities, and for movement away from said detent means to unlock it for movement of said detent means between said cavities;

said biasing means being independent of said locking means such that when said locking means is unlocked, and said cylinder members are telescopically adjusted, said biasing means will keep said detent in said slot.

6. The variable height support pillar assembly in claim 5 wherein said inner cylinder is attached to said base, and said outer cylinder is attached to said platform.

7. The assembly in claim 6 wherein said inner cylinder includes a cylindrical anchoring extension member extending upwardly into said outer cylinder and having a lower axial end.

8. The assembly in claim 7 wherein said inner cylinder contains a tie rod therein having upper and lower ends, said tie rod lower end being bolted to said base and said tie rod upper end being attached to said extension member lower axial end.

9. The assembly in claim 8 including a compressed gas cylinder inside said outer cylinder, having a lower end bearing against said lower axial end of said extension member, and having an upper end bearing against said platform.

10. The variable height support pillar assembly in claim 5 wherein said detent include a ball, said biasing means is a compression spring and a bushing is in engagement with said ball and said compression spring.

11. The assembly in claim 5 including a compressed gas cylinder inside said pillar, arranged to bias said pillar toward an extended condition.

12. The assembly in claim 11 wherein said compressed gas cylinder is unattached to said pillar.

13. The assembly in claim 5 including said vertical slot in said inner cylinder member between said spaced cavities configurated to receive said detent with a sliding fit, said detent being biased by said biasing means into said slot whereby said cylinders can move axially relative to each other without rotation of said platform.

* * * * *

UNITED STATES PATENT AND TRADEMARK OFFICE

CERTIFICATE OF CORRECTION

PATENT NO. : 5,243,921

DATED : Sep. 14, 1993

INVENTOR(S) : Gary L. Kruse et al

It is certified that error appears in the above-indentified patent and that said Letters Patent is hereby corrected as shown below:

On the Title Page, Item [57];
In the Abstract, line 9
After "plunger" insert --.--;

Column 1, line 6
After "assemblies" insert --.--;

Column 2, line 49
"rod 42" should be --rod 48--;

Column 3, line 53
After "structure" insert --.--;

Column 5, line 2, claim 1
"alienable" should be --alignable--;

UNITED STATES PATENT AND TRADEMARK OFFICE

CERTIFICATE OF CORRECTION

PATENT NO. :5,243,921

DATED :September 14, 1993

INVENTOR(S) :Gary L. Kruse, et al

It is certified that error appears in the above-indentified patent and that said Letters Patent is hereby corrected as shown below:

Column 5, line 26
"firs" should be --first--;

Column 5, line 44, claim 5
"alienable" should be --alignable--;

Column 6, line 37, claim 10
"include" should be --includes--;

Signed and Sealed this

Twenty-first Day of June, 1994

Bruce Lehman

*Attest:*

BRUCE LEHMAN

*Attesting Officer*

*Commissioner of Patents and Trademarks*